US006159374A

United States Patent [19]

Hart

[11] Patent Number: 6,159,374

[45] Date of Patent: Dec. 12, 2000

[54] SOFTENED BRINE TREATMENT OF CRUDE OIL

[75] Inventor: Paul R. Hart, The Woodlands, Tex.

[73] Assignee: BetzDearborn Inc., Trevose, Pa.

[21] Appl. No.: 09/399,648

[22] Filed: Sep. 21, 1999

Related U.S. Application Data

[63] Continuation of application No. 08/859,396, May 20, 1997, abandoned.

[51] Int. Cl.[7] ..... C02F 1/42

[52] U.S. Cl. ..... 210/638; 210/767; 210/634; 208/251 R; 252/312

[58] Field of Search ..... 208/251 R; 252/389.62, 252/312; 210/634, 708, 767, 665, 638

[56] References Cited

U.S. PATENT DOCUMENTS 3,491,835 1/1970 Gagle .
4,737,265 4/1988 Merchant, Jr. et al. .
4,806,231 2/1989 Chirinos et al. .
4,854,385 8/1989 Hurd et al. .
4,992,210 2/1991 Naeger et al. .
5,014,783 5/1991 McClure .
5,236,591 8/1993 Hart .
5,256,305 10/1993 Hart .
5,271,841 12/1993 Hart .
5,282,974 2/1994 Hart .

*Primary Examiner*—Matthew O. Savage
*Assistant Examiner*—Terry K. Cecil
*Attorney, Agent, or Firm*—Steven D. Boyd

[57] ABSTRACT

A method for removing corrosive inorganic cations—such as calcium magnesium cations—from a crude oil stream by mixing the stream with a softened brine wash water that has been softened by removal or replacement of precipitating divalent or trivalent cations with non-precipitating cations. The crude oil stream and the wash water are mixed at a temperature from about 98° C. to about 150° C. to form an emulsion wherein the corrosive inorganic cations are transferred from the crude oil to the wash water, The emulsion is then broken to form a crude oil fraction and an aqueous fraction containing at least a portion of the corrosive inorganic cations from the crude oil. This method is particularly useful in areas where freshwater is not readily available.

17 Claims, No Drawings

SOFTENED BRINE TREATMENT OF CRUDE OIL

This application is a continuation of Ser. No. 08/859,396 filed May 20, 1997, now abandoned.

FIELD OF THE INVENTION

The present invention relates to methods for removing undesirable water soluble materials from crude oil. More particularly, the present invention relates to removing divalent and trivalent cations, and particularly calcium and magnesium cations, from crude oil using softened brines.

BACKGROUND OF THE INVENTION

All crude oil contains impurities which can contribute to corrosion, heat exchanger fouling, furnace coking, catalyst deactivation and product degradation in refining and other processes. These contaminants are broadly classified as bottom sediment, water, filterable solids, organometalics and salts. The amounts of these impurities vary depending upon the particular crude. Generally, crude oil salt content ranges between about 3 and 200 pounds per 1000 barrels.

Mineral salts present in crude oil include predominantly sodium chloride with lesser amounts of magnesium chloride, calcium chloride, calcium and magnesium carbonates, bicarbonates and sulfates. The mineral salts are a result of long contact of water and crude oil with salty substrates and soil.

If crude oil is not desalted, the inorganic salts can cause corrosion problems in metal refining equipment. Chlorine bearing acidic salts such as $CaCl_2$ and $MgCl_2$ tend to hydrolyze to form HCl during handling of crude oil containing inorganic salts. If left untreated HCl can be a major source of metal corrosion. Even if treated with neutralizing amines, the resulting salt deposits can be corrosive. Divalent and trivalent cations such as $Fe^{+2}$, $Fe^{+3}$ and $Al^{+3}$, if not removed, remain in the refining residual and degrade the value of coke or carbon black made from the residual. Furthermore, solubilization or evaporation of water in heated crude can precipitate acidic, corrosive di- and trivalent chlorine salts which can foul heat exchangers, pipes and vessel surfaces.

Desalting processes remove primarily inorganic salts from the crude prior to refining. The desalting step is provided by adding and mixing with the crude a few volume percentages of fresh water to the crude oil.

In crude oil desalting, a water-in-oil emulsion is intentionally formed with the water admitted being on the order of about 2 to 12 volume percent based on the crude oil. Water is added to the crude oil and mixed intimately to transfer salts in the crude oil to the water phase. Separation of the phases occurs due to coalescence of the small water droplets into progressively larger droplets and eventual gravity separation of the oil and underlying water phase. A residue of the aqueous phase generally remains in the desalted crude; however, the salt content of the crude is reduced due to the desalting step.

Demulsification agents are added, usually upstream from the desalter to help in providing maximum mixing of the oil and water phases in the desalter. Known demulsifying agents include alkoxylated alkylphenolformaldehyde resins, a variety of polyesters, alkoxylated polyols, polyepoxides of these materials, cationic water soluble polymers, and many other commercially available compounds.

Desalters are also commonly provided with electrodes to impart an oscillating electric field in the desalter. This serves to polarize the dispersed water droplets. The so formed dipole droplets exert an attractive force between oppositely charged poles with the increased attractive force increasing the number of water droplet collisions. The water droplets elongate in the electrical field, thus creating more surface area that further enhances coalescence. Overall, the coalescence rate increases from 10 to 100 fold.

Upon separation of the phases from the water-in-oil emulsion, the crude is commonly drawn off the top of the desalter and sent to the fractionator tower in crude units or other refinery processes. The water phase containing water soluble inorganic salt compounds, water soluble organic contaminants, and water wet sediment is discharged as effluent.

Desalters are typically employed in tandem arrangement to improve salt removal efficacy. Commonly, in such designs, crude oil from the resolved emulsion in the upstream, first desalter is used as crude feed to the downstream second desalter. Fresh wash water is added to the crude stream fed to the second desalter, with water phase bottoms effluent from the second desalter being fed back as wash water to mix with the fresh crude fed to the first desalter.

Due to the advantage of heat in aiding separation, in a conventional system the crude oil fed to the first stage desalter is preheated prior to mixing with the effluent water from the second stage in feeding to the desalter unit. Thus, in a conventional two-stage desalter system both the first and second stage of the desalter train are operated at elevated temperatures.

Typically, desalters are operated at about 90° to 150° C. Heat lowers the viscosity of the oil thereby speeding the migration of the coalesced water droplets to the vessel interface as governed by Stokes law. It also increases the ability of oil to dissolve certain organic emulsion stabilizers such as surfactants that may have been added or are naturally occurring in the crude.

Desalter pressure is kept high enough to prevent crude oil or water vaporization. Desalter pressures at operating temperatures are generally about 20 psi to 100 psi above the crude oil or water vapor pressure, whichever is higher.

Emulsion breakers, also called the demulsifiers, are usually fed to the crude so as to modify the stabilizer film formed initially at the oil/water interface. Obverse emulsion breakers are relatively lipophilic surfactants, typically polymeric, that mitigate rigid interfacial barriers between water droplets allowing droplets of water in oil to coalesce more readily. Reverse emulsion breakers are relatively hydrophilic polymers, typically surface active, that mitigate the repulsive interfacial forces between oil droplets, allowing the droplets of oil in water to coagulate more readily. These demulsifiers reduce the residence time required for good separation of oil and water.

It is generally desirable to desalt crude oil shortly after production from a subterranean oil bearing formation in order to minimize the fouling and corrosion problems caused by inorganics during crude oil handling and refining. However, fresh water for desalting of crude oil is not always available or in sufficient supply at locations where crude oil is produced, such as in the Middle East, parts of North America and on off-shore oil production sites. Thus, a need exists for a method to desalt crude oil which does not require the use of fresh water. Additionally, water soluble organic compounds such as benzene, phenols and volatile organic compounds (VOC's) in aqueous effluent from desalting operations can be harmful to the environment and thus are under increasing government restriction.

In order to minimize effluent from desalting operations, recycling of effluent water is desirable if the corrosion reducing efficacy of the recycled water is retained. Recycling reduces the effluent volume and increases the salinity of the reused wash water, which decreases the partitioning of organics into the effluent brine relative to the crude oil. However, merely increasing the salinity of the effluent wash water also increases the carry over in the desalted crude of residual corrodent inorganic materials proportionally. Therefore, a need exists for a method of recycling desalter wash water which does not increase the residual corrodent material in washed crude oil.

Also, some heavy crudes have densities about the same as fresh water. Such heavy crudes are very difficult or impossible to desalt using fresh water due to insufficient force driving the stratification of the oil and water phases. A need therefore exists for a method of desalting heavy crudes employing an aqueous phase which is more dense than the heavy crude, yet is still effective for removing corrosive inorganic salts from the crude.

It is therefore an object of this invention to provide a method for removing corrodent inorganic material from crude oil which does not require the use of fresh water, and which thus avoids the problems inherent with the use of fresh water in crude oil desalting methods.

SUMMARY OF THE INVENTION

The inventor of the present invention has found that crude oil can be treated to remove corrosive and inorganic materials by washing crude oil with aqueous brine solutions which have been softened to remove divalent and trivalent cations, particularly calcium and magnesium cations. The method for removing corrosive inorganic materials from a crude oil stream comprises contacting a crude oil stream containing corrosive inorganic materials (particularly di- and trivalent cations) with a wash water comprising a softened brine to form a crude oil/wash water emulsion wherein at least a portion of said corrosive inorganic materials are transferred from said crude oil to said wash water in said emulsion. The crude oil/wash water emulsion is then broken to form a crude oil fraction and an aqueous fraction containing at least a portion of the corrosive inorganic materials from the crude oil fraction. The aqueous fraction and the crude oil fraction are then separated. The crude oil fraction is then either treated again to further decrease the concentration of corrosive inorganic materials or is refined. The aqueous fraction is then either resoftened, filtered and recycled or discharged as effluent.

DESCRIPTION OF THE PREFERRED EMBODIMENTS

In accordance with the invention described herein, it has been discovered that crude oil can be effectively treated to remove corrosive inorganic material using aqueous brine solutions which have been softened to remove di- and trivalent cations.

As used herein, the term "brine" means any solution of water, sodium chloride and optionally other salts such as but not limited to $MgCl_2$, $CaCl_2$, KaCl, $MgSO_4$, $CaSO_4$, $NaHCO_3$, $CaCO_3$, $MgCO_3$, $NaNO_3$ and the like. Unless specified herein otherwise, the term "brine" is inclusive of sea water, naturally occurring brines from surface sources or subterranean formations (geologic brines) and man made brines.

The inventor of the present invention has discovered that if brine is softened to remove divalent and trivalent cations (particularly $Ca^{+2}$ and $Mg^{+2}$) the softened brine can effectively reduce the concentration of corrosive inorganic salts in crude oil.

Water hardness is due to low percentages of calcium and magnesium carbonates, bicarbonates, sulfates or chlorides. Water hardness is generally expressed as parts per million of calcium carbonate. "Softening" is the term used for the removal or replacement of precipitating cations such as $Ca^{+2}$, $Mg^{+2}$ , $Ba^{+2}$, $Fe^{+2}$, $Fe^{+3}$ and $Al^{+3}$ with non-precipitating cations such as $Na^{+}$.

In this invention, sea water, geological and/or desalter effluent brine can be softened by any process which is available to the skilled artisan, such as, but not limited, to hydrated lime and optionally soda ash precipitation processes, ion exchange processes such as zeolite and hydrogen exchange process, membrane processes such as ultra filtration, reverse osmosis, electrodialysis, electrodialysis reversal and combinations thereof.

The softened brine is then used in a crude oil treatment method to remove corrosive inorganic cations from crude oil.

The method for removing corrosive inorganic cations from crude oil comprises the steps of:

a) contacting a crude oil stream containing corrosive inorganic cations with a wash water comprising a softened aqueous brine solution to form a crude oil/wash water emulsion wherein at least a portion of the corrosive cations in the crude oil are transferred from the crude oil to the aqueous phase of the emulsion;

b) breaking the crude oil/wash water emulsion to form a crude oil fraction and an aqueous fraction containing at least a portion of the corrosive cations from the crude oil fraction; and c) separating the aqueous fraction of step b) from the crude oil fraction of step b).

The amount of softening required for the practice of this invention will depend on the hardness of the brine or sea water employed and the concentration of salts in the particular crude oil to be desalted.

It is important that the brine be softened sufficiently to reduce the concentration of divalent and trivalent cations to a concentration less than the concentration of divalent and trivalent cations in the untreated crude oil. This requirement is necessary in order for a concentration gradient to be formed in the emulsion of step a) of the method. The concentration gradient is the driving force which causes the transfer of inorganic cations in the crude oil to the softened wash water portion of the emulsion.

After step c), the effluent brine can preferably be treated by filtration, to remove solids, and softening to remove di- and tri- valent cations. The filtered, resoftened wash water can then be reused to desalt more crude oil. The inventor believes that recycling can continue indefinitely, since once the NaCl concentration reaches the saturation point in the wash water, the NaCl will precipitate as a solid and will be removed by filtration. The only discharge should be divalent and trivalent cation rich degenerated aqueous solution which has been used to regenerate the water softening system.

The softened brine can be mixed with make-up water comprising softened brine and/or fresh water. Thus, softened brine can be used alone to desalt crude oil or it can be used with fresh water to supplement fresh water desalting systems where insufficient fresh water is available for crude oil desalting.

In addition to providing a method for desalting crude oil, which does not require the use of fresh water, the present invention also has other advantages. Softened brine is denser than fresh water and has a higher ionic strength than fresh water. Therefore, the inventor believes that using softened brine to desalt crude oil mitigates the emulsion stabilizing effects of ionic surfactants. The inventor also believes that water soluble organic materials such as benzene will partition from crude oil to a lesser extent into a softened brine than as into fresh water (the "salting out" effect), and thereby the benzene concentrations in the desalter effluent brine will be less then that which occurs in fresh water desalter effluent.

The following example demonstrates the invention in greater detail. The example is intended to be illustrative only and is not intended to limit the scope of the present invention.

EXAMPLE

Raw crude oil containing 2.1 percent emulsified solids, salts and water was treated at 290° F. in a laboratory desalter by washing the crude with 7% of one of four aqueous wash water phases.

Phase 1=Dionized water
Phase 2=5.8% (1.0 N) NaCl
Phase 3=4.7% (1.0 N) $MgCl_2$
Phase 4=5.5% (1.0 N) $CaCl_2$ In order to reproduce field conditions 15 ppm of an obverse demulsifier and 5% of a naphtha cutter solution were added to the crude sample.

The 9.1% total aqueous phase was allowed to drop for 64 minutes (the approximate residence time of the water phase in a field desalter) and the top 85% was thiefed and distilled at 730° F. while sparging with 3.7% by weight steam to reproduce atmospheric tower bottom conditions.

The distilled vapors were sparged through 4.9% 1.0 N NaOH to collect the evolved HCl as NaCl. The results are shown in Tables I and II below:

TABLE I

| Aqueous | Water Drop Reading+ (%, at min. Indicated) | | | | | | |
|---|---|---|---|---|---|---|---|
| Wash Phase | 1 | 2 | 4 | 8 | 16 | 32 | 64 |
| D.I. Water | 0.2 | 1.5 | 3.3 | 4.8 | 5.7 | 6.6 | 7.0 |
| 5.8% NaCl | 0.1 | 1.2 | 3.1 | 5.4 | 6.3 | 6.6 | 7.7 |
| 4.5% $MgCl_2$ | 0.0 | 1.4 | 3.4 | 5.4 | 6.1 | 6.7 | 7.5 |
| 5.5% $CaCl_2$ | 0.2 | 1.7 | 4.1 | 5.8 | 6.6 | 6.9 | 7.6 |

TABLE II

| Aqueous Wash Phase | Water Drop Mean | Effluent Brine pH | Overhead Cl's Distilled (ptb*) |
|---|---|---|---|
| D.I. Water | 4.15 | 7.9 | 4.1 |
| 5.8% NaCl | 4.35 | 7.4 | 2.8 |
| 4.5% $MgCl_2$ | 4.36 | 7.1 | 75.5 |
| 5.5% $CaCl_2$ | 4.70 | 6.4 | 44.6 |

+average of duplicates, average difference between duplicates = 0.2% pts.
*Cl as lbs of NaCl/Mbbl of crude charge.

The tables show that softened brine containing 5.8% NaCl effectively lowers the overhead chlorine content and therefore reduces the corrosivity of the desalted crude oil to a greater extent than obtained by deionized water.

Thus, the present invention provides a method for removing corrosive inorganic materials, particularly divalent and trivalent cations from crude oil using softened aqueous brines such as softened geological brine, softened desalter effluent brine or softened sea water.

The invention has particular utility for removing magnesium and calcium salts from crude oil and is useful for desalting crude oil in locations where the availability of fresh water limits the practicality of using fresh water to desalt crude oil, where there are limits on the ability to discharge desalter effluent brine to the environment and/or where crude oils have densities approximately that of fresh water.

While the present invention has been described with respect to particular embodiments thereof, it is apparent that numerous other forms and modifications of this invention will be obvious to those skilled in the art. The appended claims and this invention should be construed to cover all such obvious forms and modifications which are within the true scope and spirit of the present invention.

I claim:

1. A method for removing corrosive inorganic cations from a crude oil stream after production from a subterranean oil bearing formation, said method comprising:

a) contacting a crude oil stream containing corrosive inorganic cations with a wash water comprising a softened brine which has been softened by removal or replacement of Precipitating divalent or trivalent cations with non-precipitating cations; and b)

mixing said crude oil stream and said wash water at a temperature of from about 98° C. to about 150° C. to form a crude oil/wash water emulsion wherein at least a portion of said corrosive inorganic cations are transferred from said crude oil to said wash water in said emulsion;

c) breaking said crude oil/wash water emulsion to form a crude oil fraction and an aqueous fraction containing at least a portion of said corrosive inorganic cations from said crude oil fraction; and d) separating said aqueous fraction of step c) from said crude oil fraction of step c).

2. The method of claim 1 wherein said wash water further comprises a demulsifier.

3. The method of claim 1 wherein said softened brine is obtained by softening an aqueous brine solution obtained from a subterranean formation, by softening sea water, by softening an aqueous brine solution obtained as effluent from a crude oil desalter or by a combination thereof.

4. The method of claim 1 further comprising the steps e) softening said aqueous fraction of step d) by removal or replacement of precipitating divalent and trivalent cations with non-precipitating cations; and f) optionally adding make-up wash water comprising fresh water or softened brine which has been softened by removal or replacement of precipitating divalent and trivalent cations with non-precipitating cations to said aqueous fraction of step e) to form a softened brine wash water; and g) repeating steps a)–g) until a predetermined amount of corrosive inorganic salts remain in said crude oil.

5. The method of claim 4 wherein the softened brine is softened by replacement of precipitating divalent or trivalent cations with non-precipitating cations.

6. The method of claim 1 wherein the softened brine is softened by replacement of precipitating divalent or trivalent cations with non-precipitating cations.

7. A method for removing corrosive divalent and trivalent inorganic cations from a crude oil stream after production from a subterranean oil bearing formation, said method comprising:

a) mixing a crude oil stream containing divalent and trivalent cations with a softened brine wash water stream at a temperature of from about 90° C. to 150° C., which has been softened to remove or replace precipitating divalent or trivalent cations with non-precipitating cations to form a crude oil/softened wash water emulsion wherein at least a portion of said corrosive inorganic cations are transferred from said crude oil to said softened wash water in said emulsion;

b) breaking said crude oil/wash water emulsion to form a crude oil fraction and an aqueous fraction containing at least a portion of said corrosive inorganic cations from said crude oil fraction; and c) separating said aqueous fraction of step b) from said crude oil fraction of step b).

8. The method of claim 7 further comprising the steps d) softening said aqueous fraction of step c) by removal or replacement of precipitating divalent and trivalent cations with non-precipitating cations; and e) optionally adding make-up wash water comprising fresh water or softened brine which has been softened by removal or replacement of precipitating divalent and trivalent cations with non-precipitating cations to said aqueous fraction of step d) to form softened brine wash water; and f) repeating steps a)–f) until a predetermined amount of corrosive inorganic salts remain in said crude oil.

9. The method of claim 8 wherein the softened brine is softened by replacement of precipitating divalent or trivalent cations with non-precipitating cations.

10. The method of claim 7 wherein said wash water stream is obtained by softening an aqueous brine solution obtained from a subterranean formation, by softening sea water, by softening an aqueous brine solution obtained as effluent from a crude oil desalter or by a combination thereof.

11. A method for reducing the concentration of divalent and trivalent cations in a crude oil stream after production from a subterranean oil bearing formation, said method comprising:

a) softening a wash water stream containing NaCl and divalent and trivalent cations to remove or replace at least a portion of precipitating divalent and trivalent cations with non-precipitating cations;

b) mixing a crude oil stream containing divalent cations and trivalent cations with said wash water stream of step a) at a temperature of from about 90° C. to 150° C. to form a crude oil/wash water emulsion wherein at least a portion of said corrosive inorganic cations are transferred by a concentration gradient from said crude oil to said wash water in said emulsion;

c) breaking said crude oil/wash water emulsion to form a crude oil fraction and an aqueous fraction containing at least a portion of said divalent and trivalent cations from said crude oil fraction; and d) separating said aqueous fraction of step c) from said crude oil fraction of step c);

e) softening said aqueous fraction of step d) by removal or replacement of precipitating divalent and trivalent cations with non-precipitating cations; and f) optionally adding make-up wash water comprising fresh water or softened brine which has been softened by removal or replacement of precipitating divalent and trivalent cations with non-precipitating cations to said aqueous fraction of step e) to form a softened brine wash water; and g) repeating steps a)–g) until a predetermined amount of divalent and trivalent cations remains in said crude oil.

12. The method of claim 11 wherein said wash water stream is a geologic brine, sea water or a man-made brine.

13. The method of claim 11 wherein the softened brine is softened by replacement of precipitating divalent or trivalent cations with non-precipitating cations.

14. A method for treating a crude oil stream after production from a subterranean oil bearing formation, said method comprising:

a) contacting a crude oil stream containing corrosive inorganic cations with a wash water comprising a softened brine which has been softened by removal or replacement of precipitating divalent and trivalent cations with non-precipitating cations; and b) mixing said crude oil stream and said wash water at a temperature of from about 98° C. to 150° C. to form a crude oil/wash water emulsion wherein at least a portion of said corrosive inorganic cations are transferred from said crude oil to said wash water in said emulsion;

c) breaking said crude oil/wash water emulsion to form a crude oil fraction and an aqueous fraction containing at least a portion of said corrosive inorganic cations from said crude oil fraction; and d) separating said aqueous fraction of step c) from said crude oil fraction of step c).

15. The method of claim 14 wherein said inorganic corrosive cations include divalent and trivalent cations and the softened brine has a concentration of divalent and trivalent cations less than a concentration of divalent and trivalent cations in the crude oil.

16. The method of claim 14 wherein the divalent cations are selected from the group consisting of $Ca^{+2}$, $Mg^{+2}$, $Ba^{+2}$, and $Fe^{+2}$, and the trivalent cations are selected from the group consisting of $Fe^{3+}$ and $A^{3+}$.

17. The method of claim 14 wherein the softened brine is softened by replacement of precipitating divalent or trivalent cations with non-precipitating cations.

* * * * *